US005884836A

United States Patent [19]

Hatano et al.

[11] Patent Number: 5,884,836

[45] Date of Patent: Mar. 23, 1999

[54] ENFORCEMENT STRUCTURE OF A FILE FOLDER

[76] Inventors: Nobuaki Hatano, 9 Pinewood Circle, Wellesely, Mass. 02181; Hsieh Feng-Chuan, 11F-2, No. 378,Sec. 1, Wen Hsin Rd., Taichung, Taiwan

[21] Appl. No.: 9,818

[22] Filed: Jan. 20, 1998

[51] Int. Cl.[6] ..... B65D 27/12

[52] U.S. Cl. ..... 229/67.4; 229/67.1; 24/67.11

[58] Field of Search ..... 229/67.1, 67.4; 24/67.11

[56] References Cited

U.S. PATENT DOCUMENTS

| | | | |
|---|---|---|---|
| 3,099,269 | 7/1963 | Sorensen | 24/67.11 |
| 5,226,676 | 7/1993 | Su | 229/67.1 X |
| 5,285,952 | 2/1994 | Ho | 229/67.4 |
| 5,639,016 | 6/1997 | Ho | 229/67.4 |
| 5,692,670 | 12/1997 | Ho | 229/67.1 |

*Primary Examiner*—Jes F. Pascua
*Attorney, Agent, or Firm*—Rosenberg, Klein & Bilker

[57] ABSTRACT

A file folder includes a base plate and a clamping member. The base plate has three folding lines defined in parallel in one of two sides thereof so as to define a first, a second, and a third part, wherein an opening is defined through the first and the second part. The third part is folded downwardly along the third folding line and has a tongue extending foldably upward from a free edge thereof. A plurality of corrugated units are formed to integrally connect a root portion of the tongue and the third part. The clamping member has a lower portion thereof attached to an underside of the base plate and a upper potion thereof inserted into the opening. The upper portion of the clamping member has an engaging member formed by reversely folding a free edge thereof so as to engage with the tongue of the base plate such that a pile of document is able to be clamped between the third part and the base plate.

4 Claims, 5 Drawing Sheets

ENFORCEMENT STRUCTURE OF A FILE FOLDER

BACKGROUND OF THE INVENTION

1. Field of the Invention

The present invention relates to a file folder and, more particularly, to an improved file folder having an enforcement structure to be engaged with a clamping member.

2. Brief Description of the Prior Art

FIGS. 1 to 3 show a conventional file folder including a plate 10 and a clamping member 20. The plate 10 has a first folding line 101, a second folding line 102 and a third folding line 103 defined in a side thereof, the three folding lines 101, 102 and 103 are parallel with each other. A first part 104 is defined between the first and the second folding lines 101, 102, a second part 105 defined between the second and the third folding line 102, 103, and a third part 106 extending from the third folding line 103. The third part 106 has a tongue 107 extending therefrom so that a fourth folding line 108 is defined between the third part 106 and the tongue 107. An opening 13 is defined through the first and the second part 104, 105. The clamping member 20 includes a lower portion 201 and an upper portion 202 with a connecting portion 203 connected therebetween, wherein the upper portion 202 has an engaging member 204 formed by reversely folding a distal edge thereof. The lower portion 201 of the clamping member 20 is attached to an underside of the plate 10 and the upper portion 202 is inserted through the opening 13 and pressed on the third part 106. The tongue 107 is then folded to press on the engaging member 204. The clamping member 20 and the plate 10 are materially made so that a pile of document 11 can be securely clamped between the plate 10 and the third part 106. However, the tongue 107 is simple a thin plate and bears a large torque force when the pile of document to be clamped has a certain thickness so that a fatigue of the tongue 107 will be found within a short period of time.

The present invention intends to provide an improved file folder having an enforcement structure to mitigate and/or obviate the above-mentioned problems.

SUMMARY OF THE INVENTION

In one aspect of the present invention, there is provided a file folder comprising a base plate having a first side and a second side in which a first folding line, a second folding line and a third folding line are respectively defined in parallel with each other so as to define a first part between the first and the second folding line, a second part between the second and the third folding line, and a third part foldably extending downward from the second part with the third folding line defined therebetween. A tongue extends foldably upward from a free edge of the third part and an opening is defined through the first part and the second part. A plurality of corrugated units are formed along the free edge of the third part so as to integrally connect the third part and a root portion of the tongue.

A clamping member has a lower portion and an upper portion with a connecting portion connected therebetween. The upper portion has an engaging member formed by reversely folding a free edge thereof. The lower portion is attached to an underside of the base plate and the upper portion is inserted into the opening so as to engage the engaging member with the tongue.

It is an object of the present invention to provide a file folder having an enforcement structure to integrally connect a tongue and a third part thereof.

It is another object of the present invention to provide a file folder which has a longer life term of usage.

Other objects, advantages, and novel features of the invention will become more apparent from the following detailed description when taken in conjunction with the accompanying drawings.

DETAILED DESCRIPTION OF THE PREFERRED EMBODIMENTS

Figure 4:
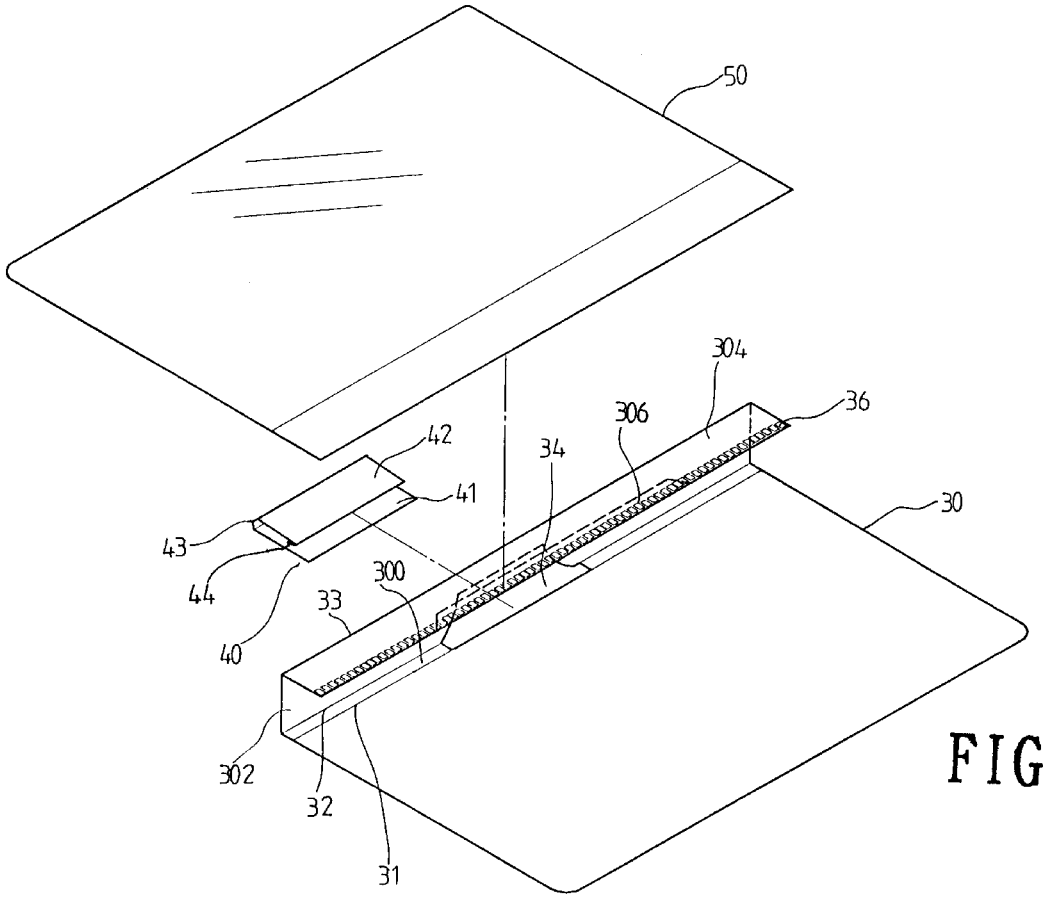
FIG. 4 is an exploded view of a file folder in accordance with the present invention.
Figure 5:
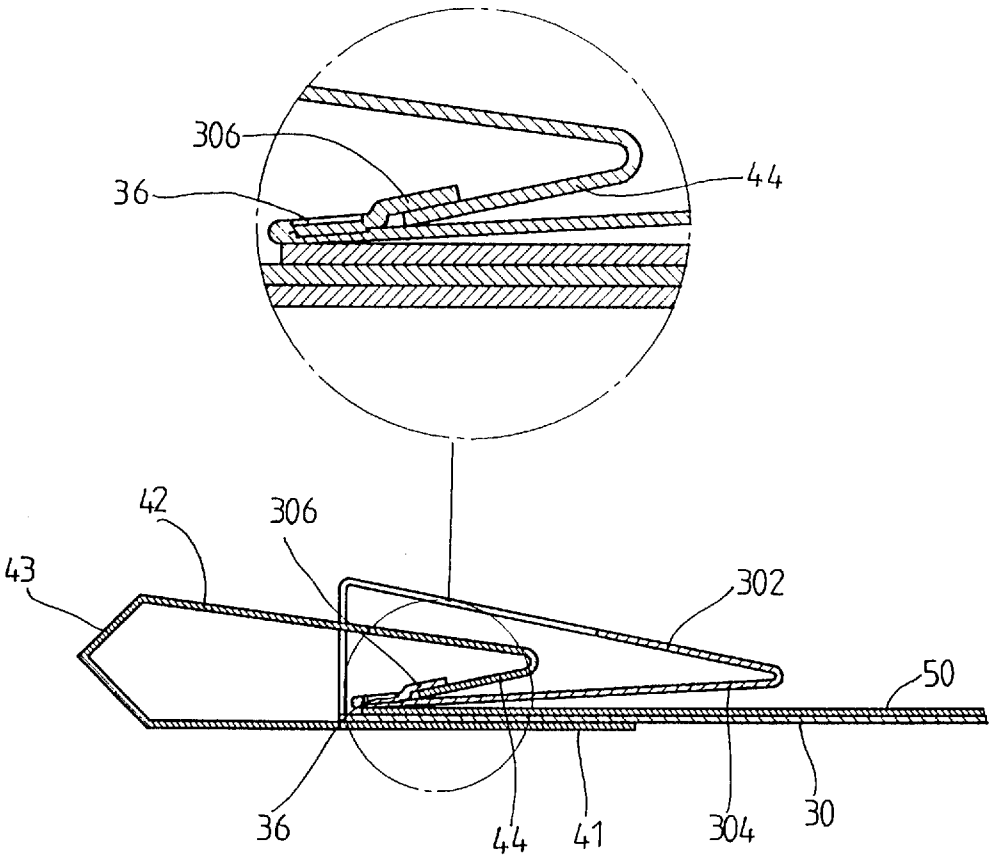
FIG. 5 is a side elevational view, partly in section, of the file folder having a pile of document clamped thereto.

Referring to the drawings and initially to FIGS. 4 and 5, a file folder in accordance with the present invention generally includes a base plate 30 having a first side and a second side in which a first folding line 31, a second folding line 32 and a third folding line 33 are respectively defined. The first, the second and the third folding line 31, 32, 33 are located in parallel with each other so as to define a first part 300 between the first and the second folding line 31, 32, a second part 302 between the second and the third folding line 32, 33, and a third part 304 foldably extending downward from the second part 302 with the third folding line 33 defined therebetween. A tongue 306 extends foldably upward from a free edge of the third part 304 and an opening 34 defined through the first part 300 and the second part 302, wherein the opening 34 has a width smaller than that of the tongue 306. A plurality of corrugated units 36, rectangular corrugated units in this embodiment, are formed along the free edge of the third part 304 so as to integrally connect the third part 304 and a root portion of the tongue 306. The corrugated units 36 are formed by heating the material and pressing the third part 304 and the root portion of the tongue 306 so that the overlapped portion is formed to be an enforcement structure.

A clamping member 40 has a lower portion 41 and an upper portion 42 with a connecting portion 43 connected therebetween. The upper portion 42 has an engaging member 44 formed by reversely folding a free edge thereof. When assembling the file folder, the lower portion 41 is attached to an underside of the base plate 30 and the upper portion 41 is inserted into the opening 34 so as to engage the engaging member 44 with the tongue 306 as shown in FIG. 5. It is to be noted that the engaging member 44 pulls the tongue 306 together with the third part 304 upwardly so that a downward biasing force is applied to a pile of document 50 so as to position the same.

Figure 1:
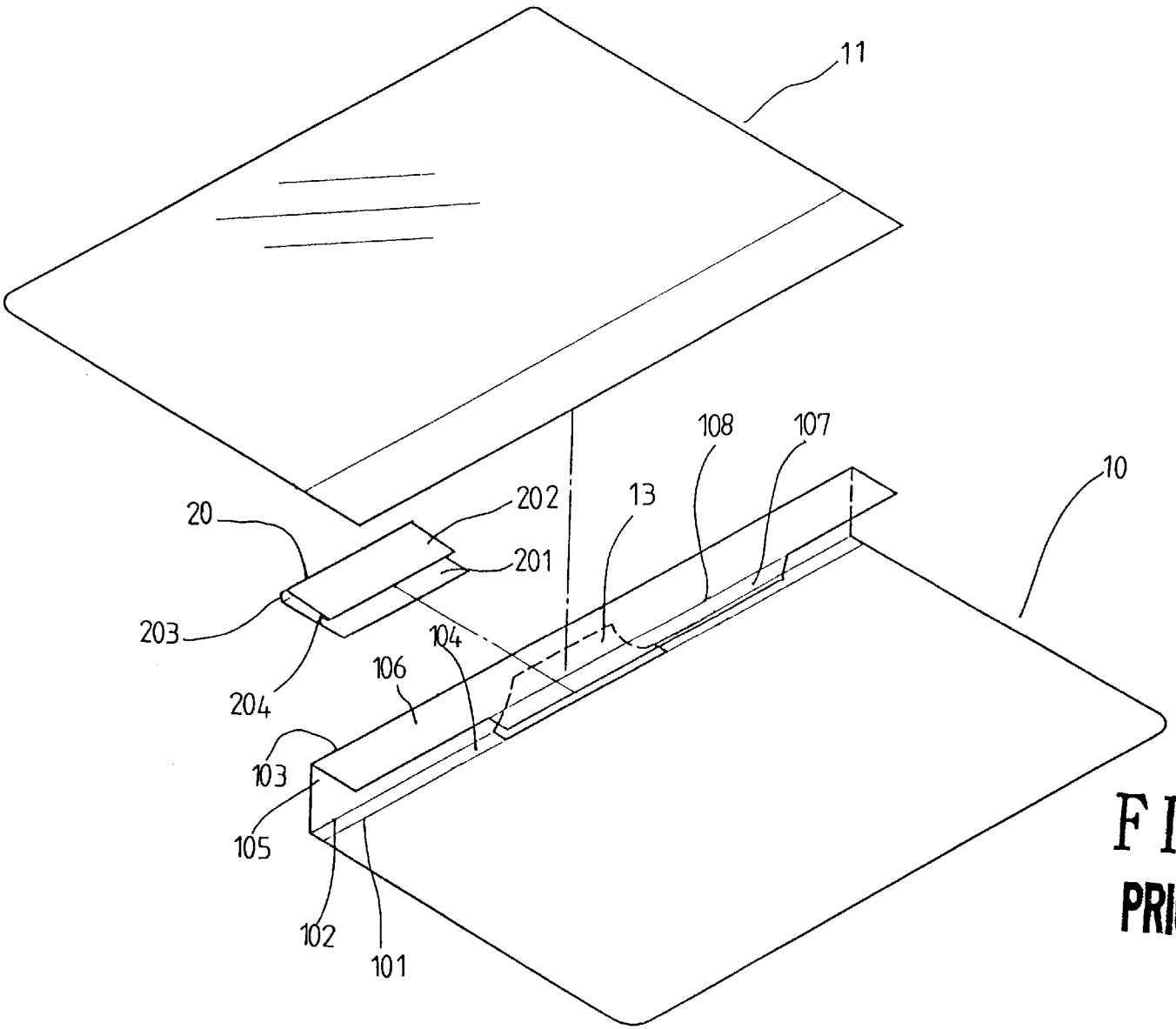
FIG. 1 PRIOR ART
FIG. 1 is an exploded view of a conventional file folder.
Figure 2:
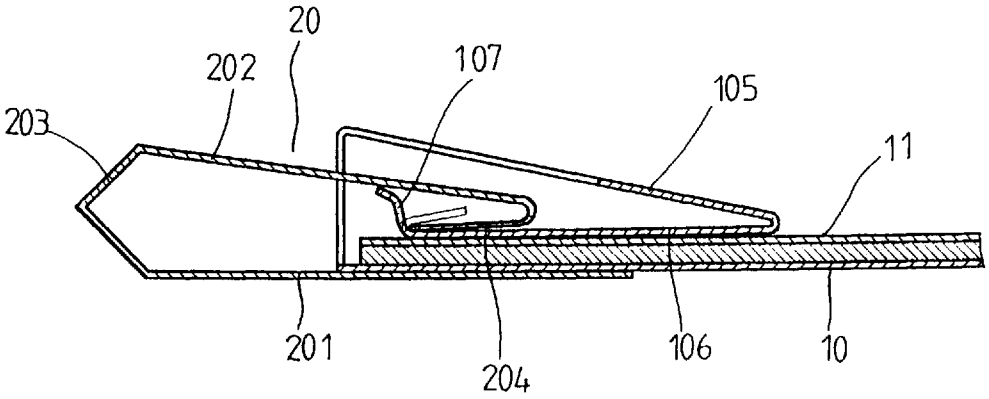
FIG. 2 PRIOR ART
FIG. 2 is a side elevational view, partly in section, of the conventional file folder having a pile of document clamped thereto.
Figure 3:
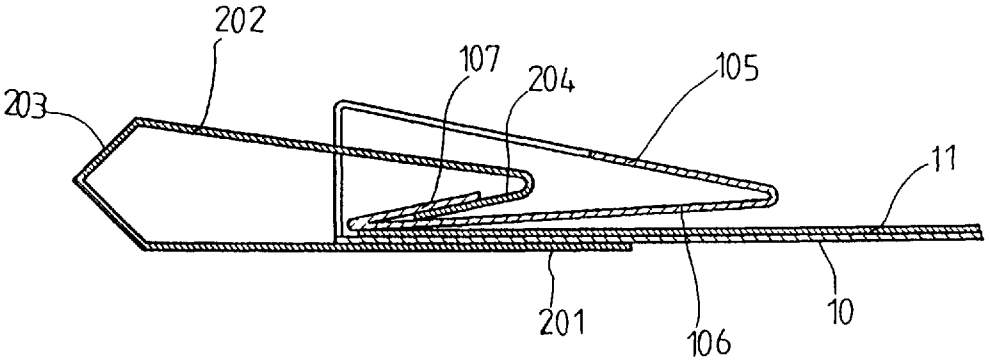
FIG. 3 PRIOR ART
FIG. 3 is a side elevational view, partly in section, of the conventional file folder having a thinner pile of document clamped thereto.

The corrugated units 36 provide a stronger structure when compared with the simple plate-type described in the prior art shown in FIGS. 1–3 so that the file folder of the present invention will have a longer life of term.

Figures 6, 7:
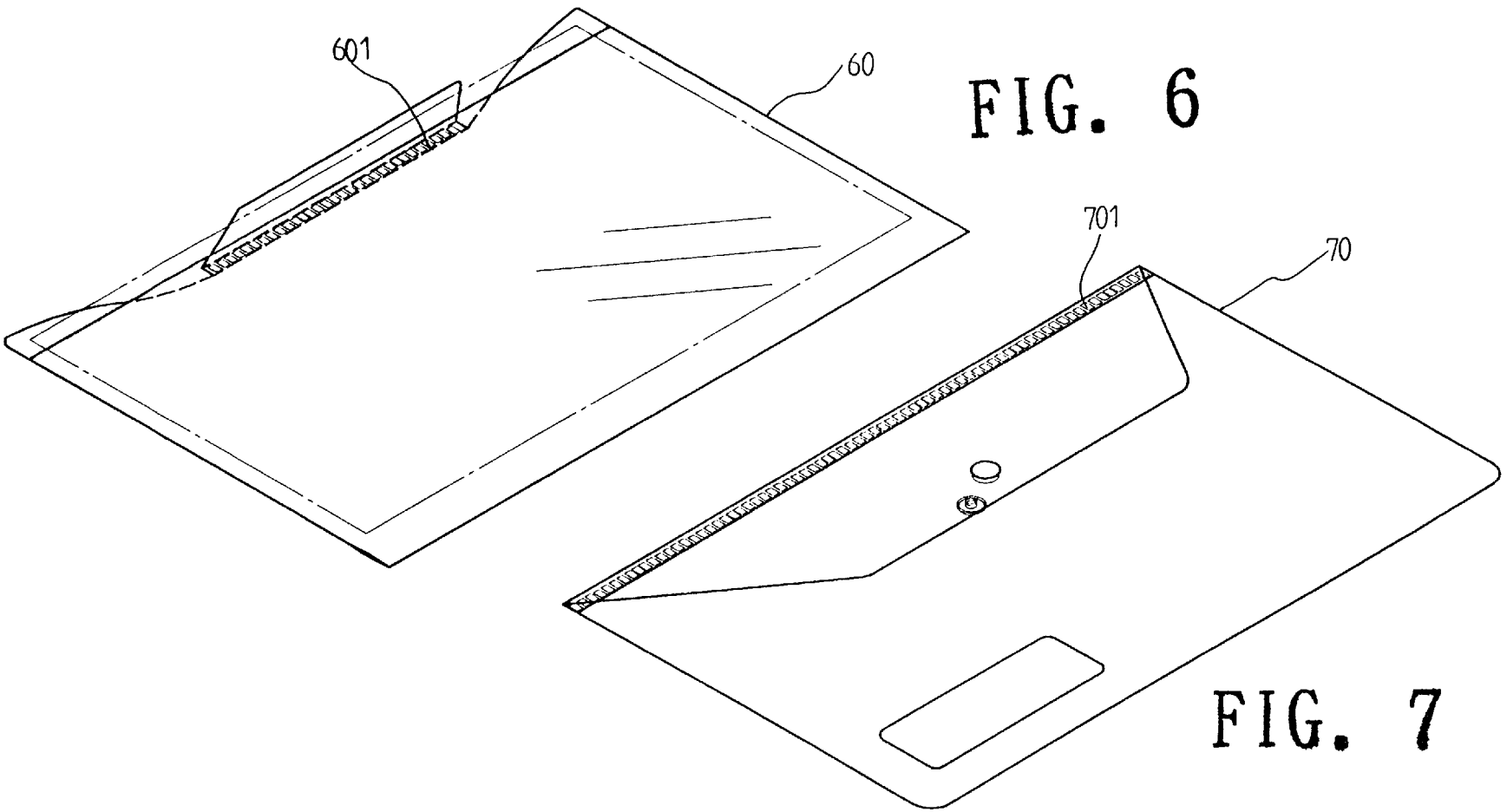
FIG. 6 is a perspective view to show another type of file folder having corrugated units defined therein.
FIG. 7 is a perspective view to show yet another type of file folder having corrugated units defined therein.

FIGS. 6 and 7 respective show two different types of file folder and each of which has the corrugated units 601, 701 formed thereto so as to provide necessary enforcement structure at suitable portions thereof.

Although the invention has been explained in relation to its preferred embodiment, it is to be understood that many other possible modifications and variations can be made without departing from the spirit and scope of the invention as hereinafter claimed.

What is claimed is:

1. A file folder comprising:

a base plate having a first side and a second side in which a first folding line, a second folding line and a third folding line are respectively defined, said first, said second and said third folding line being located in parallel with each other so as to define a first part between said first and said second folding line, a second part between said second and said third folding line, and a third part foldably extending downward from said second part with said third folding line defined therebetween, a tongue extending foldably upward from a free edge of said third part and an opening defined through said first part and said second part, a plurality of corrugated units formed along said free edge of said third part so as to integrally connect said third part and a root portion of said tongue, and a clamping member having a lower portion and an upper portion with a connecting portion connected therebetween, said upper portion having an engaging member formed by reversely folding a free edge thereof, said lower portion attached to an underside of said base plate and said upper portion inserted into said opening so as to engage said engaging member with said tongue.

2. The file folder as claimed in claim 1 wherein said corrugated units are formed by a heating-pressing process applied to said third part and said tongue.

3. The file folder as claimed in claim 1 wherein each of said corrugated units is formed to be a rectangular unit.

4. The file folder as claimed in claim 1 wherein said opening has a width smaller than that of said tongue.

* * * * *